US011525579B2

(12) United States Patent
Shershnyov et al.

(10) Patent No.: US 11,525,579 B2
(45) Date of Patent: Dec. 13, 2022

(54) COMBUSTOR NOZZLE, COMBUSTOR, AND GAS TURBINE INCLUDING SAME

(71) Applicant: DOOSAN ENERBILITY CO., LTD, Changwon-si (KR)

(72) Inventors: Borys Shershnyov, Changwon (KR); Mu Hwan Chon, Changwon (KR)

(73) Assignee: DOOSAN ENERBILITY CO., LTD., Changwon (KR)

( * ) Notice: Subject to any disclaimer, the term of this patent is extended or adjusted under 35 U.S.C. 154(b) by 0 days.

(21) Appl. No.: 17/356,555

(22) Filed: Jun. 24, 2021

(65) Prior Publication Data

US 2022/0003415 A1 Jan. 6, 2022

(30) Foreign Application Priority Data

Jul. 6, 2020 (KR) ..... 10-2020-0082979

(51) Int. Cl.

| | |
|---|---|
| ***F23R 3/28*** | (2006.01) |
| ***F23R 3/14*** | (2006.01) |
| ***F23D 14/70*** | (2006.01) |
| ***F23D 14/64*** | (2006.01) |

(52) U.S. Cl.

CPC ..... *F23R 3/286* (2013.01); *F23D 14/64* (2013.01); *F23D 14/70* (2013.01); *F23R 3/14* (2013.01); *F23C 2900/07001* (2013.01); *F23D 2206/10* (2013.01)

(58) Field of Classification Search

CPC .... F23R 3/14; F23R 3/16; F23R 3/286; F23D 14/64; F23C 2900/07001

See application file for complete search history.

(56) References Cited

U.S. PATENT DOCUMENTS

| | | | | |
|---|---|---|---|---|
| 2,174,266 | A * | 9/1939 | Jackson | F23R 3/14 60/39.38 |
| 4,013,395 | A | 3/1977 | Wormser | |
| 5,351,477 | A * | 10/1994 | Joshi | F23D 17/002 60/737 |
| 9,046,262 | B2 * | 6/2015 | Kim | F23C 7/004 |
| 9,395,084 | B2 * | 7/2016 | Bobba | F23R 3/14 |
| 9,932,940 | B2 | 4/2018 | Lo | |
| 10,473,333 | B2 * | 11/2019 | Yang | F23R 3/18 |
| 2004/0050057 | A1 | 3/2004 | Bland | |

(Continued)

FOREIGN PATENT DOCUMENTS

| | | |
|---|---|---|
| EP | 1488086 B1 | 11/2012 |
| JP | 2001280641 | 10/2001 |

(Continued)

OTHER PUBLICATIONS

KR OA dated Jun. 25, 2021.

*Primary Examiner* — Todd E Manahan
*Assistant Examiner* — Sean V Meiller
(74) *Attorney, Agent, or Firm* — Harvest IP Law LLP

(57) ABSTRACT

A combustor nozzle capable of injecting fuel uniformly, a combustor including the combustor nozzle, and a gas turbine including the combustor are provided. The combustor nozzle includes a premix passage in which air and fuel are mixed, wherein the premix passage includes a plurality of pegs configured to inject fuel and guide an air flow and a plurality of mixing bars configured to mix air and fuel injected from the plurality of pegs, the mixing bar having a twisted structure.

15 Claims, 9 Drawing Sheets

(56) References Cited

U.S. PATENT DOCUMENTS

| | | | | |
|---|---|---|---|---|
| 2009/0056336 | A1* | 3/2009 | Chila | F23R 3/14 60/737 |
| 2010/0071374 | A1 | 3/2010 | Fox | |

FOREIGN PATENT DOCUMENTS

| | | |
|---|---|---|
| KR | 20190109955 | 9/2019 |
| KR | 20200038698 | 4/2020 |

* cited by examiner

COMBUSTOR NOZZLE, COMBUSTOR, AND GAS TURBINE INCLUDING SAME

CROSS REFERENCE TO RELATED APPLICATION

This application claims priority to Korean Patent Application No. 10-2020-0082979, filed on Jul. 7, 2020, the disclosure of which is incorporated herein by reference in its entirety.

BACKGROUND

1. Field

Apparatuses and methods consistent with exemplary embodiments relate to a combustor nozzle, a combustor having the same, and a gas turbine including the same.

2. Description of the Related Art

A gas turbine is a combustion engine in which a mixture of air compressed by a compressor and fuel is combusted to produce a high temperature gas that drives a turbine. The gas turbine is used to drive electric generators, aircraft, ships, trains, or the like.

The gas turbine includes a compressor, a combustor, and a turbine. The compressor serves to intake external air, compress the air, and transfer the compressed air to the combustor. The compressed air compressed by the compressor has a high temperature and a high pressure. The combustor serves to mix compressed air compressed by the compressor and fuel and combust the mixture of compressed air and fuel to produce combustion gas discharged to the gas turbine. The combustion gas drives turbine blades in the turbine to produce power. The generated power is applied to a variety of applications such as generation of electricity, driving of mechanical units, etc.

Fuel is injected through nozzles installed in each combustor, and gaseous fuel may be premixed inside the nozzle and injected. To reduce NOx, fuel and gas need to be uniformly mixed. However, a related art combustor nozzle has a problem in that fuel and air are not uniformly mixed.

SUMMARY

Aspects of one or more exemplary embodiments provide a combustor nozzle capable of injecting fuel uniformly, a combustor including the combustor nozzle, and a gas turbine including the combustor.

Additional aspects will be set forth in part in the description which follows and, in part, will become apparent from the description, or may be learned by practice of the exemplary embodiments.

According to an aspect of an exemplary embodiment, there is provided a combustor nozzle including: a premix passage in which air and fuel are mixed, wherein the premix passage includes a plurality of pegs configured to inject fuel and guide an air flow and a plurality of mixing bars configured to mix air and fuel injected from the plurality of pegs, the mixing bar having a twisted structure.

The combustor nozzle may further include a main cylinder having a fuel passage through which fuel flows and a nozzle shroud surrounding the main cylinder, wherein the plurality of pegs and the plurality of mixing bars are disposed inside the main cylinder.

The plurality of pegs and the plurality of mixing bars may be arranged around a circumference of the main cylinder.

Each of the plurality of mixing bars may include a twist part and a first plate part fixed to a front side of the twist part, wherein a rear side of the twist part is fixed to a front side of the peg.

The twist part of each of the plurality of mixing bars may have a first section rotated 180 degrees and a second section positioned in front of the first section and rotated 180 degrees, wherein the second section is formed to be longer than the first section.

A twist guide may be disposed between the plurality of mixing bars in the main cylinder, wherein the twist guide is twisted with respect to a central axis thereof.

The twist guide may include a twist part, a first plate part fixed to a front side of the twist part, and a second plate part fixed to a rear side of the twist part.

The first plate part and the second plate part may be disposed parallel to a radial direction of the main cylinder.

The first plate part may be disposed parallel to a radial direction of the main cylinder, and the second plate part may be disposed perpendicular to the radial direction of the main cylinder.

The twist guide and the mixing bar may be twisted in different directions.

A plurality of auxiliary guides may be disposed in front of the plurality of mixing bars and the twist guide such that the auxiliary guide is alternately disposed with the mixing bar and the twist guide, the auxiliary guide having a twist part twisted about a central axis thereof.

Each of the plurality of mixing bars may be curved with respect to a longitudinal direction of the main cylinder.

The combustor nozzle may further include a fuel injection module disposed between the main cylinder and the nozzle shroud to inject fuel, wherein the fuel injection module includes a plurality of first struts each protruding from the main cylinder and having an injection hole for injecting fuel, and a first support tube coupled to outer sides of the first struts and having a plurality of intermediate injection holes for injecting fuel.

An intermediate transfer passage may be disposed inside the first support tube to extend in a circumferential direction, wherein the intermediate transfer passage is connected to a strut passage formed inside the first strut.

The fuel injection module may further include a plurality of second struts each protruding from the first support tube and having a strut injection hole for injecting fuel, wherein the second strut has a strut passage connected to the strut injection hole, the strut passage being connected to the intermediate transfer passage.

The fuel injection module may further include a second support tube connecting outer sides of the second struts, and a plurality of third struts protruding from the second support tube, wherein the nozzle shroud includes an outer transfer passage connected to the third struts to extend in the circumferential direction of the nozzle shroud.

According to an aspect of another exemplary embodiment, there is provided a combustor including: a burner having a plurality of nozzles configured to inject fuel and air, and a duct assembly coupled to one side of the burner to burn a mixture of the fuel and air and transmit combustion gas to a turbine, wherein each of the plurality of nozzles includes a premix passage in which air and fuel are mixed, a plurality of pegs configured to inject fuel and guide an air inflow in the premix passage, and a plurality of mixing bars configured to mix air and fuel injected from the plurality of pegs, the mixing bar having a twisted structure.

Each of the plurality of nozzles may further include a main cylinder having a fuel passage through which fuel flows and a nozzle shroud surrounding the main cylinder, wherein the plurality of pegs and the plurality of mixing bars are disposed inside the main cylinder such that the plurality of mixing bars are fixed to a front side of the peg and the plurality of pegs and the plurality of mixing bars are arranged around a circumference of the main cylinder, and a plurality of twist guides are disposed between the plurality of mixing bars in the main cylinder, the twist guide having a structure that is twisted with respect to a central axis of the twist guide.

According to an aspect of another exemplary embodiment, there is provided a gas turbine including: a compressor configured to compress air introduced from an outside, a combustor configured to mix the air compressed by the compressor with fuel and combust an air-fuel mixture to produce high-temperature and high-pressure combustion gas, and a turbine having a plurality of turbine blades rotating by the combustion gas produced by the combustor, wherein the combustor includes a burner having a plurality of nozzles configured to inject fuel and air, and a duct assembly coupled to one side of the burner to burn a mixture of the fuel and air and transmit combustion gas to the turbine, wherein each of the plurality of nozzles includes a premix passage in which air and fuel are mixed, a plurality of pegs configured to inject fuel and guide an air inflow in the premix passage, and a plurality of mixing bars configured to mix air and fuel injected from the plurality of pegs, the mixing bar having a twisted structure.

Each of the plurality of nozzles may further include a main cylinder having a fuel passage through which fuel flows and a nozzle shroud surrounding the main cylinder, wherein the plurality of pegs and the plurality of mixing bars are disposed inside the main cylinder such that the plurality of mixing bars are fixed to a front side of the peg and the plurality of pegs and the plurality of mixing bars are arranged around a circumference of the main cylinder, and a plurality of twist guides are disposed between the plurality of mixing bars in the main cylinder, the twist guide having a structure that is twisted with respect to the central axis of the twist guide.

According to the combustor nozzle, the mixing bar twisted in front of the peg is installed, so that air and fuel discharged from the peg may be mixed more uniformly.

BRIEF DESCRIPTION OF THE DRAWINGS

The above and other aspects will become more apparent from the following description of the exemplary embodiments with reference to the accompanying drawings, in which.

DETAILED DESCRIPTION

Figure 1:
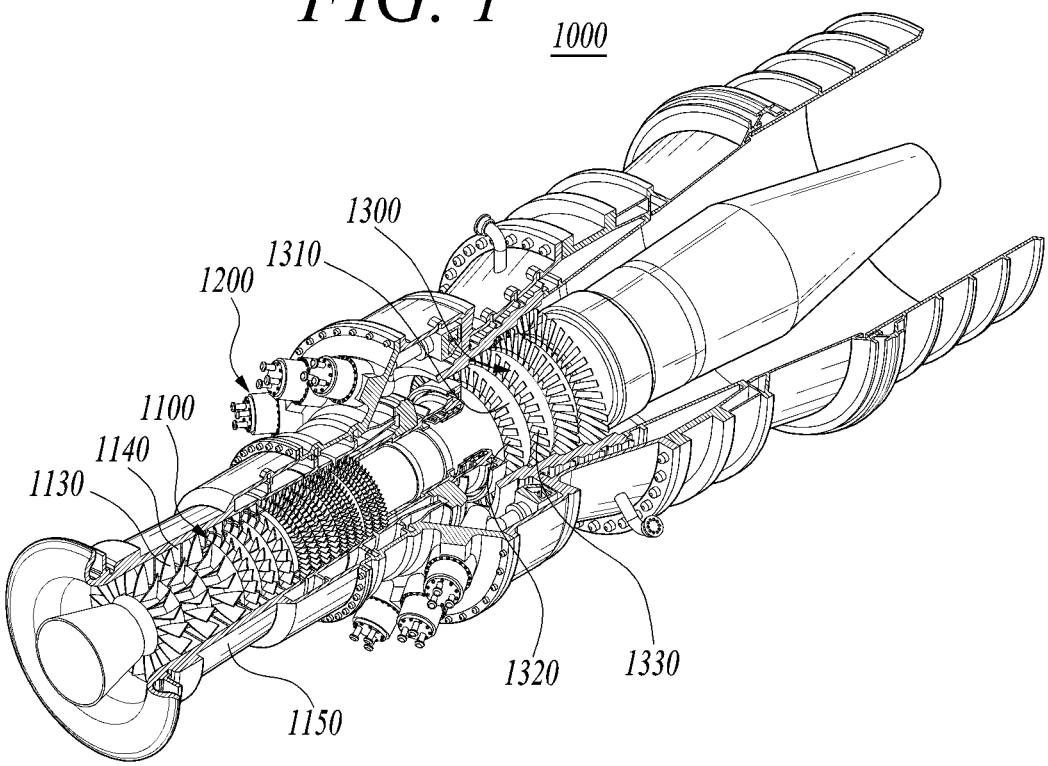
FIG. 1 is a view illustrating an interior of a gas turbine according to a first exemplary embodiment.

Various modifications and various embodiments will be described in detail with reference to the accompanying drawings. However, it should be noted that the various embodiments are not for limiting the scope of the disclosure to the specific embodiment, but they should be interpreted to include all modifications, equivalents, or substitutions of the embodiments included within the spirit and scope disclosed herein.

Terms used herein are used to merely describe specific embodiments, and are not intended to limit the scope of the disclosure. As used herein, an element expressed as a singular form includes a plurality of elements, unless the context clearly indicates otherwise. Further, it will be understood that the term "comprising" or "including" specifies the presence of stated features, numbers, steps, operations, elements, parts, or combinations thereof, but does not preclude the presence or addition of one or more other features, numbers, steps, operations, elements, parts, or combinations thereof.

Hereinafter, exemplary embodiments will be described in detail with reference to the accompanying drawings. It is noted that like reference numerals refer to like parts throughout the various figures and exemplary embodiments. In certain embodiments, a detailed description of known functions and configurations that may obscure the gist of the present disclosure will be omitted. For the same reason, some of the elements in the drawings are exaggerated, omitted, or schematically illustrated.

Hereinafter, a gas turbine according to a first exemplary embodiment will be described with reference to the accompanying drawings.

Figure 2:
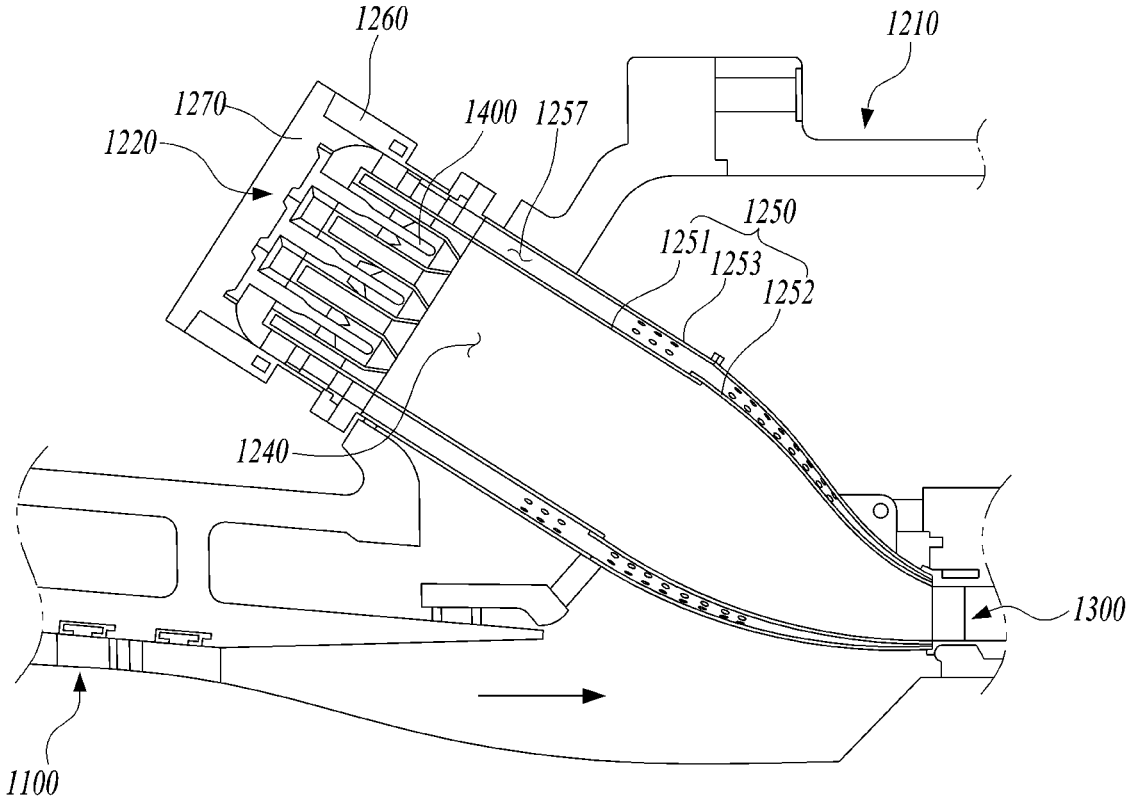
FIG. 2 is a view illustrating a combustor of FIG. 1.

FIG. 1 is a view illustrating an interior of a gas turbine according to an exemplary embodiment, and FIG. 2 is a view illustrating a combustor of FIG. 1.

An ideal thermodynamic cycle of a gas turbine 1000 may ideally comply with the Brayton cycle. The Brayton cycle consists of four thermodynamic processes: an isentropic compression (i.e., an adiabatic compression) process, an isobaric combustion process, an isentropic expansion (i.e., an adiabatic expansion) process, and isobaric heat ejection process. That is, in the Brayton cycle, thermal energy may be released by combustion of fuel in an isobaric environment after atmospheric air is sucked and compressed into high pressure air, hot combustion gas may be expanded to be converted into kinetic energy, and exhaust gas with residual energy may be discharged to the outside. As such, the Brayton cycle consists of four thermodynamic processes including compression, heating, expansion, and exhaust.

The gas turbine 1000 employing the Brayton cycle includes a compressor 1100, a combustor 1200, and a turbine 1300. Although the following description will be described with reference to FIG. 1, the present disclosure may be widely applied to other turbine engines similar to the gas turbine 1000 illustrated in FIG. 1.

Referring to FIG. 1, the compressor 1100 of the gas turbine 1000 may suck and compress air. The compressor 1100 may supply the compressed air by compressor blades 1130 to a combustor 1200 and also supply cooling air to a high temperature region of the gas turbine 1000. Here, because the sucked air is compressed in the compressor 1100 through an adiabatic compression process, the pressure and temperature of the air passing through the compressor 1100 increases.

The compressor 1100 may be designed in the form of a centrifugal compressor or an axial compressor, wherein the centrifugal compressor is applied to a small-scale gas turbine, whereas a multi-stage axial compressor is applied to a large-scale gas turbine 1000 illustrated in FIG. 1 to compress a large amount of air. In the multi-stage axial compressor 1100, the compressor blades 1130 rotate according to the rotation of rotor disks, compress the introduced air and move the compressed air to compressor vanes 1140 disposed at a following stage. The air is compressed gradually to a high pressure while passing through the compressor blades 1130 formed in multiple stages.

The compressor vanes 1140 are mounted inside a housing 1150 in such a way that a plurality of compressor vanes 1140 form each stage. The compressor vanes 1140 guide the compressed air moved from compressor blades 1130 disposed at a preceding stage toward compressor blades 1130 disposed at a following stage. For example, at least some of the compressor vanes 1140 may be mounted so as to be rotatable within a predetermined range, e.g., to adjust an air inflow.

The compressor 1100 may be driven using a portion of the power output from the turbine 1300. To this end, as illustrated in FIG. 1, a rotary shaft of the compressor 1100 and a rotary shaft of the turbine 1300 may be directly connected. In the case of the large-scale gas turbine 1000, almost half of the output produced by the turbine 1300 may be consumed to drive the compressor 1100. Accordingly, improving the efficiency of the compressor 1100 has a direct effect on improving the overall efficiency of the gas turbine 1000.

The turbine 1300 includes a rotor disk 1310, a plurality of turbine blades 1320 and turbine vanes 1330 arranged radially on the rotor disk 1310. The rotor disk 1310 has a substantially disk shape, and a plurality of grooves are formed in an outer circumferential portion thereof. The grooves are formed to have a curved surface so that the turbine blades 1320 are inserted into the grooves, and the turbine vanes 1330 are mounted in a turbine casing. The turbine blades 1320 may be coupled to the rotor disk 1310 in a manner such as a dovetail connection. The turbine vanes 1330 are fixed so as not to rotate and guide a flow direction of the combustion gas passing through the turbine blades 1320. The turbine blades 1320 generate rotational force while rotating by the combustion gas.

The combustor 1200 may mix the compressed air supplied from an outlet of the compressor 1100 with fuel and combust the mixture at constant pressure to produce combustion gas with high energy. FIG. 2 illustrates an example of the combustor 1200 provided in the gas turbine 1000. The combustor 1200 may include a combustor casing 1210, burners 1220, and a duct assembly 1250.

The combustor casing 1210 has an approximately cylindrical shape to surround the burners 1220. The burners 1220 may be disposed downstream of the compressor 1100 along the cylindrical combustor casing 1210. Each of the burners 1220 includes a plurality of nozzles 1400, through which fuel is sprayed into and mixed with air in a proper ratio to form a fuel-air mixture having conditions suitable for combustion.

The gas turbine 1000 may use gas fuel, liquid fuel, or a combination thereof. In order to create a combustion environment for reducing emissions such as carbon monoxides or nitrogen oxides, a gas turbine has a recent tendency to apply a premixed combustion scheme that is advantageous in reducing emissions through lowered combustion temperature and homogeneous combustion even though it is difficult to control the premixed combustion.

In premixed combustion, compressed air is mixed with fuel sprayed from the nozzles 1400 in advance, and then enters a combustion chamber 1240. When the premixed gas is initially ignited by an igniter and then a combustion state is stabilized, the combustion state is maintained by supplying fuel and air.

Referring to FIG. 2, the duct assembly 1250 is provided to connect a section between the burners 1220 and the turbine 1300 so that the compressed air flows along an outer surface of the duct assembly 1250, along which high-temperature combustion gas flows to heat the duct assembly 1250, thereby properly cooling the heated duct assembly 1250.

The duct assembly 1250 may include a liner 1251, a transition piece 1252, and a flow sleeve 1253. The duct assembly 1250 has a double-wall structure in which the flow sleeve 1253 surrounds the liner 1251 and the transition piece 1252. The liner 1251 and the transition piece 1252 are cooled by the compressed air introduced into a cooling path 1257 formed inside the flow sleeve 1253.

The liner 1251 is a tube member connected to the burners 1220 of the combustor 1200, and the combustion chamber 1240 is an internal space of the liner 1251. The liner 1251 has one longitudinal end coupled to the burner 1220 and the other longitudinal end coupled to the transition piece 1252.

The transition piece 1252 is connected an inlet of the turbine 1300 to guide the high-temperature combustion gas toward the turbine 1300. The transition piece 1252 has one longitudinal end coupled to the liner 1251 and the other longitudinal end coupled to the turbine 1300. The flow sleeve 1253 serves to protect the liner 1251 and the transition piece 1252 and to prevent high temperature heat from being discharged directly to the outside.

A nozzle casing 1260 is coupled to an end of the duct assembly 1250, and a head plate 1270 is coupled to the nozzle casing 1260 to support the nozzles 1400.

A nozzle casing 1260 has a substantially circular tube shape to surround a plurality of nozzles 1400. The nozzle casing 1260 has one end coupled to the duct assembly 1250 and the other end coupled to a head plate 1270 installed on a rear side of the nozzle casing 1260. The plurality of nozzles 1400 may be installed inside the nozzle casing 1260 such that the nozzles 1400 are spaced apart along the circumference of the nozzle casing 1260.

The head plate 1270 has a disk shape and is coupled to the nozzle casing 1260 to support the nozzles 1400. The head plate 1270 may be provided with the plurality of nozzles 1400 and a fuel injector supplying fuel to the nozzles 1400. A nozzle flange 1470 may be fixed to the head plate 1270 to support the nozzles 1400.

Figure 3:
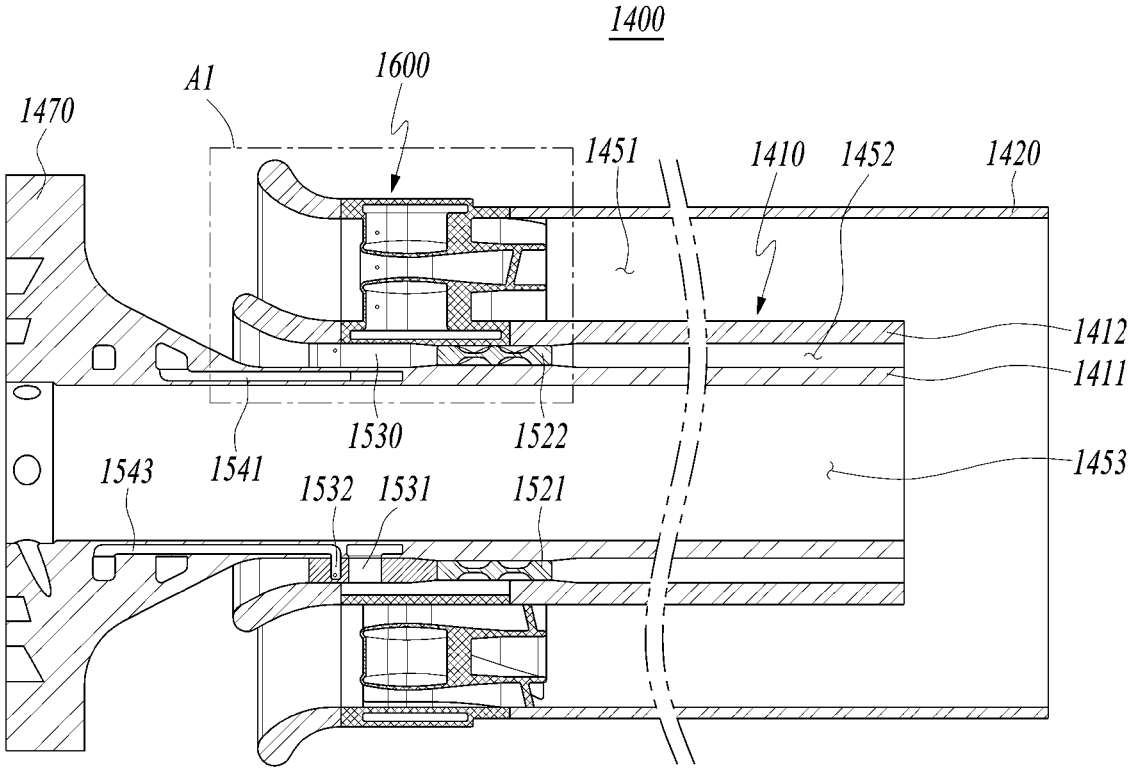
FIG. 3 is a cross-sectional view illustrating a nozzle cut along a longitudinal direction according to the first exemplary embodiment.
Figure 4:
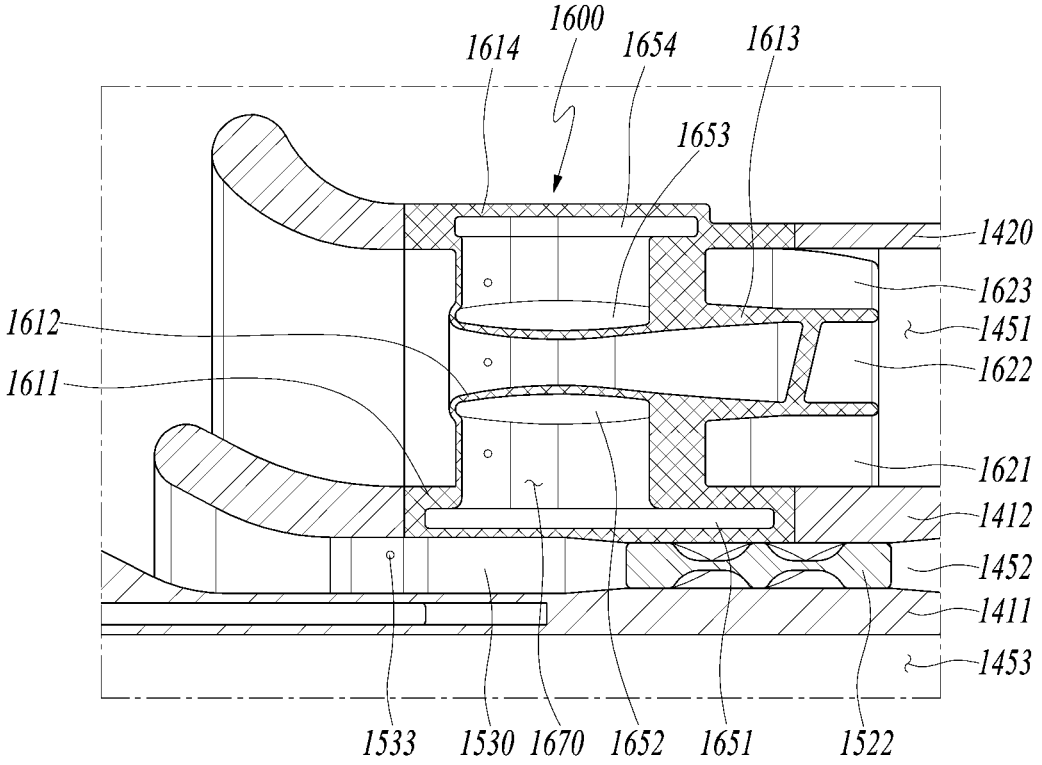
FIG. 4 is an enlarged view illustrating section A1 in FIG. 3.
Figure 5:
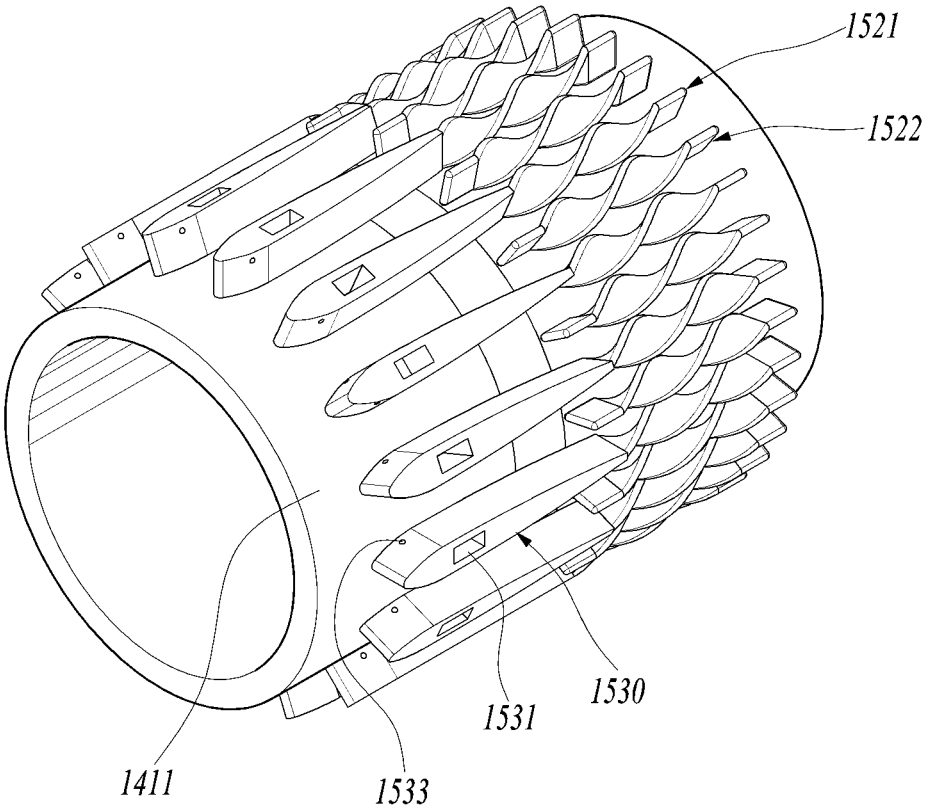
FIG. 5 is a perspective view illustrating an inner tube, a peg, and a mixing bar according to the first exemplary embodiment.
Figure 6:
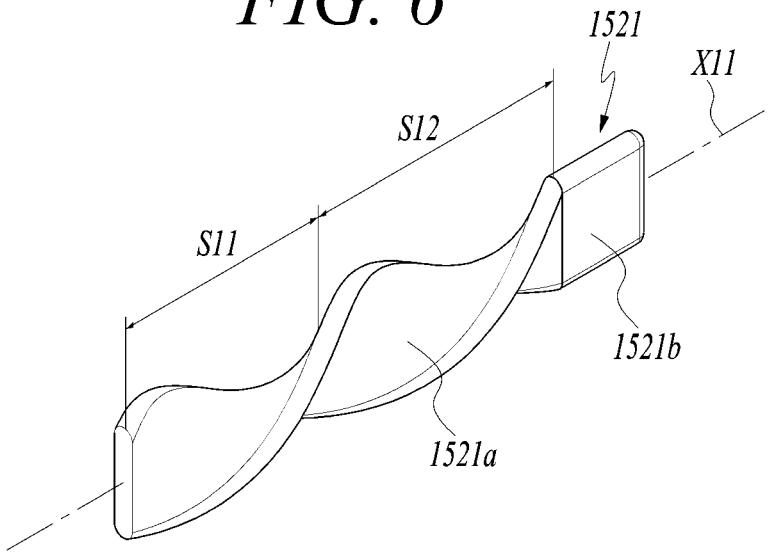
FIG. 6 is a perspective view illustrating the mixing bar according to the first exemplary embodiment.
Figure 7:
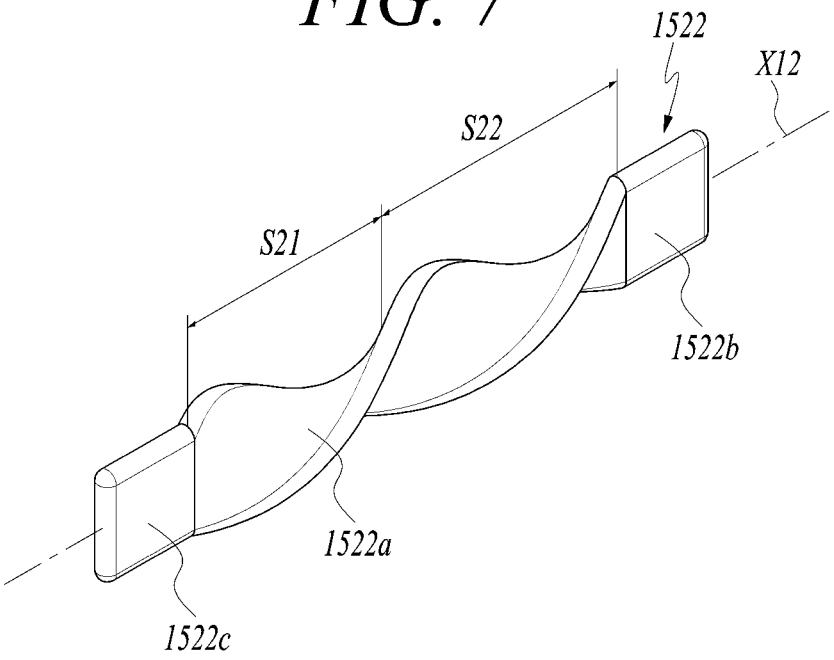
FIG. 7 is a perspective view illustrating a twist guide according to the first exemplary embodiment.

FIG. 3 is a cross-sectional view illustrating a nozzle cut along a longitudinal direction according to the first exemplary embodiment, FIG. 4 is an enlarged view illustrating section A1 in FIG. 3, FIG. 5 is a perspective view illustrating an inner tube, a peg, and a mixing bar according to the first exemplary embodiment, FIG. 6 is a perspective view illustrating the mixing bar according to the first exemplary embodiment, and FIG. 7 is a perspective view illustrating a twist guide according to the first exemplary embodiment.

Referring to FIGS. 3 to 5, the nozzle 1400 includes a main cylinder 1410, a nozzle shroud 1420 surrounding the main cylinder 1410, a fuel injection module 1600 injecting fuel between the main cylinder 1410 and the nozzle shroud 1420, a peg 1530 installed inside the main cylinder 1410, and a mixing bar 1521 disposed in front of the peg 1530. Here, the front and rear sides are based on an air flow direction in the nozzle 1400.

The main cylinder 1410 and the nozzle shroud 1420 have a coaxial structure, and fuel and air are supplied into the main cylinder 1410. A first premix passage 1451 through which air flows is formed in a space between the nozzle shroud 1420 and the main cylinder 1410, and fuel may be injected into the first premix passage 1451. The main cylinder 1410 may include an inner tube 1411, an outer tube 1412 surrounding the inner tube 1411, and a distribution member coupled to the inner tube 1411 and the outer tube 1412 to supply fuel to the fuel injection module 1600.

A second premix passage 1452 is formed between the inner tube 1411 and the outer tube 1412, and the first premix passage 1451 is formed between the nozzle shroud 1420 and the main cylinder 1410. A main fuel passage 1453 may be formed inside the inner tube 1411 so that liquid fuel is supplied therethrough. However, it is understood that the fuel is not limited thereto, and gaseous fuel may be supplied through the main fuel passage 1453. A blunt body for dispersing liquid fuel may be installed in front of the main fuel passage 1453.

Air is introduced into the first premix passage 1451 and the second premix passage 1452, and an inlet through which air is introduced may be formed on a rear side of the nozzle shroud 1420 and the outer tube 1412. Gaseous fuel may be injected into the first premix passage 1451 and the second premix passage 1452.

The rear side of the inner tube 1411 is connected to the nozzle flange 1470 to receive fuel from the nozzle flange 1470. A first fuel passage 1541 for supplying fuel to the fuel injection module 1600 and a second fuel passage 1543 for supplying fuel into the peg 1530 may be formed inside the inner tube 1411.

A plurality of first fuel passages 1541 and second fuel passages 1543 may be formed in the inner tube 1411 such that the first fuel passages 1541 and the second fuel passages 1543 are spaced apart from each other in the circumferential direction of the inner tube 1411.

The peg 1530 and the mixing bar 1521 are installed inside the main cylinder 1410, more specifically between the inner tube 1411 and the outer tube 1412. The peg 1530 injects fuel into the space between the inner tube 1411 and the outer tube 1412 and guides an air flow.

A connection passage 1531 for supplying fuel to the fuel injection module 1600 and an injection passage 1532 for supplying fuel to a vane injection hole 1533 formed in the peg 1530 are formed inside the peg 1530. The connection passage 1531 and the injection passage 1532 are separated so that the fuel in the connection passage 1531 and the fuel in the injection passage 1532 are not mixed. The injection passage 1532 may be located behind the connection passage 1531.

The mixing bar 1521 is located in front of the peg 1530 between the inner tube 1411 and the outer tube 1412. Accordingly, air flows into the mixing bar 1521 along with the fuel injected from the peg 1530. The mixing bar 1521 is formed of an elongated rectangular plate and has a structure twisted with respect to a central axis X11 of the mixing bar 1521. The mixing bar 1521 may be twisted at an angle from 90 degrees to 720 degrees. Accordingly, lateral sides of the mixing bar 1521 extend in a spiral pattern.

In the main cylinder 1410, twist guides 1522 are provided between the mixing bars 1521. The twist guides 1522 may be located in front of a space between the pegs 1530. The twist guide 1522 is formed of an elongated rectangular plate and has a structure twisted with respect to a central axis X12 of the twist guide 1522. The twist guide 1522 may be twisted at an angle from 90 degrees to 720 degrees. Accordingly, lateral sides of the twist guide 1522 extend in a spiral pattern.

The mixing bars 1521 and the twist guides 1522 are alternately arranged along the circumference of the main cylinder 1410, and the lateral sides of the mixing bars 1521 and the twist guides 1522 are overlapped for efficient mixing of fuel. However, it is understood that this is not limited thereto, and the mixing bars 1521 and the twist guides 1522 may be spaced apart at intervals. In addition, the mixing bars 1521 and the twist guides 1522 may be twisted in the same direction.

Referring to FIG. 6, the mixing bar 1521 includes a twist part 1521*a* and a first plate part 1521*b* fixed to a front side of the twist part 1521*a*. The rear side of the twist part 1521*a* is fixed to a front side of the peg 1530 so that the mixing bar 1521 mixes the fuel and air injected from the peg 1530. The first plate part 1521*b* is disposed parallel to a radial direction of the main cylinder 1410, and accordingly, an inner lateral side of the first plate part 1521*b* may be fixed to the inner tube 1411, and an outer lateral side of the first plate part 1521*b* may be fixed to the outer tube 1412.

The twist part 1521*a* includes a first section S11 twisted 180 degrees from a portion connected to the peg 1530 and a second section S12 twisted 180 degrees from the front side of the first section S11, and the second section S12 may be longer than the first section S11. In the second section S12, the twist part 1521*a* may be formed to become more open as it goes forward.

Accordingly, in the mixing bar 1521, the fuel and air are mixed in the first section S11 to obtain a strong rotational force, and flow forward with the rotational force at an increased flow rate compared to the first section S11 so that swirls spread and are mixed with swirls from the twist guide 1522 containing more air, resulting in a more even mixture of fuel and air.

Referring to FIG. 7, the twist guide 1522 includes a twist part 1522*a*, a first plate part 1522*b* fixed to a front side of the twist part 1522*a*, and a second plate part 1522*c* fixed to a rear side of twist part 1522*a*. The first plate part 1522*b* and the second plate part 1522*c* have a planar shape and are spaced apart from each other with the twist part 1522*a* interposed therebetween. The twist part 1522*a* has a structure in which a flat rod is twisted.

The first plate part 1522*b* and the second plate part 1522*c* may be disposed parallel to the radial direction of the main cylinder 1410. To this end, the twist part 1522*a* may be twisted 360 degrees. When the first plate part 1522*b* and the second plate part 1522*c* are arranged in the radial direction of the main cylinder 1410, the first plate part 1522*b* and the second plate part 1522*c* are stably fixed to the inner tube 1411 and the outer tube 1412.

The twist part 1522*a* includes a first section S21 twisted 180 degrees in the second plate part 1522*c* and a second section S22 twisted 180 degrees from the front side of the first section S21, and the second section S22 may be longer than the first section S21. In the second section S22, the twist part 1522*a* may be formed to become more open as it goes forward. The twist part 1522*a* of the twist guide 1522 has the same structure as the twist part 1521*a* of the mixing bar 1521.

Figure 8:
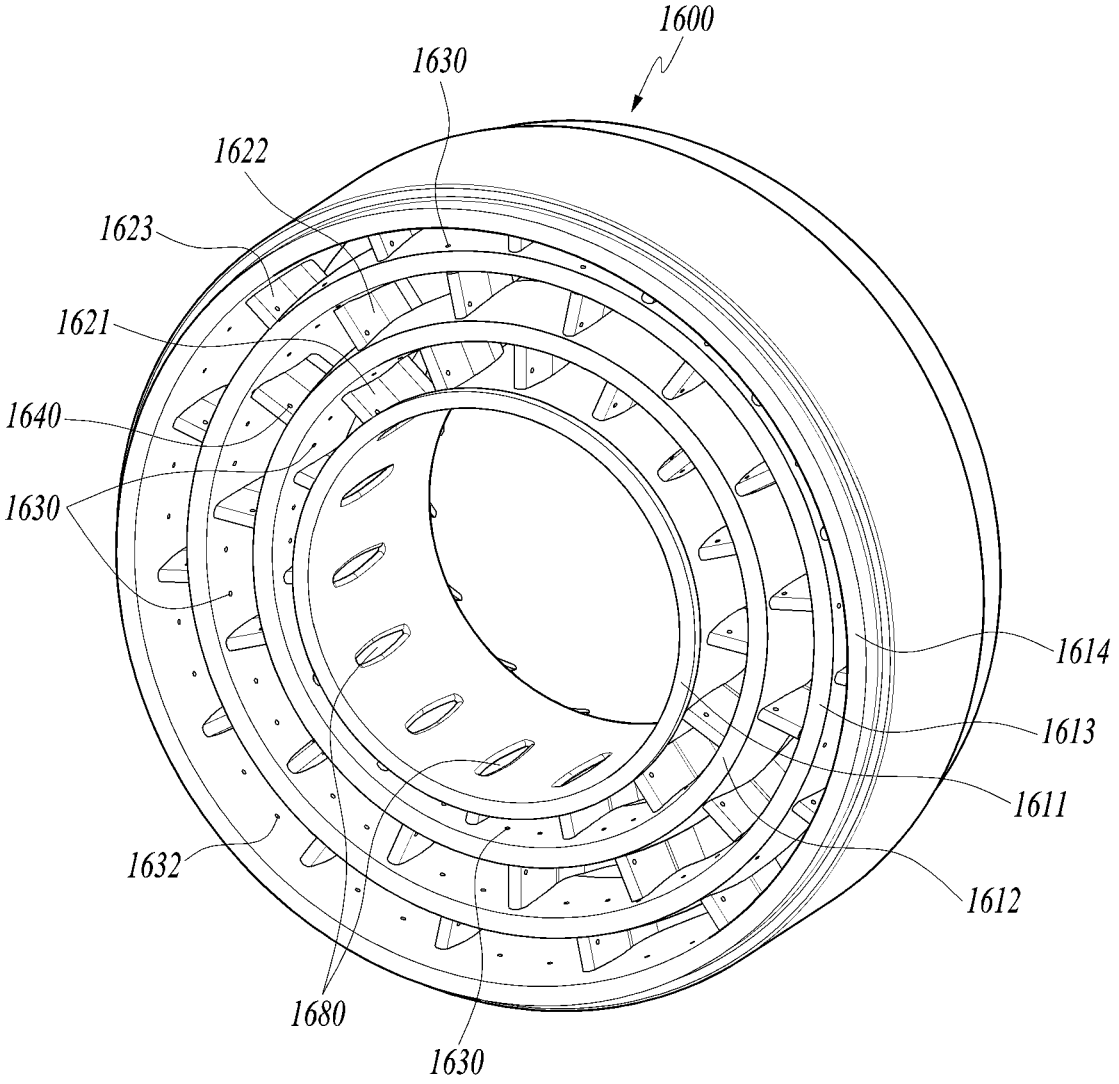
FIG. 8 is a perspective view illustrating a fuel injection module according to the first exemplary embodiment.
Figure 9:
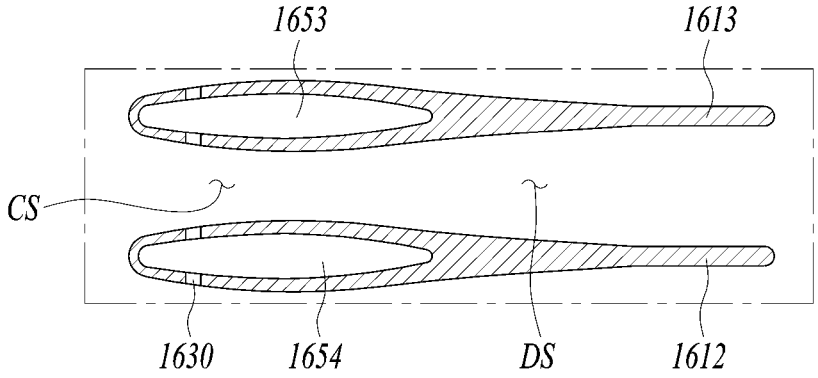
FIG. 9 is a longitudinal sectional view illustrating a first support tube and a second support tube according to the first exemplary embodiment.

FIG. 8 is a perspective view illustrating a fuel injection module according to the first exemplary embodiment. FIG. 9 is a longitudinal sectional view illustrating a first support tube and a second support tube according to the first exemplary embodiment.

Referring to FIGS. 4 and 8, the fuel injection module 1600 is connected to the main cylinder 1410 to inject fuel into the first premix passage 1451. An outer side of the fuel injection module 1600 is fitted to the nozzle shroud 1420, and an inner side of the fuel injection module 1600 is fitted to the outer tube 1412. The fuel injection module 1600 may include a first strut 1621, a second strut 1622, a third strut 1623, an inner support tube 1611, a first support tube 1612, a second support tube 1613, and an outer support tube 1614.

The inner support tube 1611 is coupled to the outer tube 1412 and may include a plurality of inlet ports 1680 through which fuel is introduced. The inlet ports 1680 are spaced apart in the circumferential direction of the inner support tube 1611. A distribution passage 1651 is formed between the inner support tube 1611 and the outer tube 1412 to connect in the circumferential direction of the outer tube 1412, and the inlet ports 1680 are connected to the distribution passage 1651.

The first support tube 1612 is coupled to outer sides of the first struts 1621 to support the first struts 1621. The inner support tube 1611 and the first support tube 1612 have a circular ring shape and may be arranged in a coaxial structure.

An intermediate transfer passage 1652 is formed inside the first support tube 1612 to connect in the circumferential direction and is connected to a strut passage 1670 formed inside the first strut 1621 to receive fuel from the strut 1621. In addition, the intermediate transfer passage 1652 is connected to a strut passage 1670 formed inside the second strut 1622 to deliver fuel to the second strut 1622. A plurality of intermediate injection holes 1630 for injecting fuel are formed on the inner and outer surfaces of the first support tube 1612 and are connected to the intermediate transfer passage 1652.

The second support tube 1613 is coupled to outer sides of the second struts 1622 to support the second struts 1622. The second support tube 1613 and the first support tube 1612 have a circular ring shape and may be arranged in a coaxial structure.

An intermediate transfer passage 1653 is formed inside the second support tube 1613 to connect in the circumferential direction and is connected to the strut passage 1670 formed inside the second strut 1622 to receive fuel from the second strut 1622. In addition, the intermediate transfer passage 1653 is connected to the strut passage 1670 formed inside the third strut 1623 to deliver fuel to the third strut 1623. A plurality of intermediate injection holes 1630 for injecting fuel are formed on the inner and outer surfaces of the second support tube 1613 and are connected to the intermediate transfer passage 1653.

Referring to FIG. 9, the first support tube 1612 and the second support tube 1613 have a structure in which outer surfaces thereof are convexly curved, and thickness gradually increases from an outer side toward a central part in a width direction. Accordingly, between the first support tube 1612 and the second support tube 1613, a convergent section CS in which an area of a flow path gradually decreases and a divergent section DS in which an area of a flow path gradually increases are formed. A strut injection hole 1640 may be formed in the convergent section CS.

Accordingly, a flow of air and fuel passing through the first support tube 1612 and the second support tube 1613 may be stabilized. In addition, even if the intermediate transfer passage 1652 is formed inside the first support tube 1612 having a ring shape, it is possible to minimize the first support tube 1612 from interfering with the flow.

The outer support tube 1614 is coupled to outer sides of the third struts 1623 to support the third struts 1623. The outer support tube 1614 has a circular ring shape and is fitted into the nozzle shroud 1420 to constitute the nozzle shroud 1420.

An outer transfer passage 1654 is formed inside the outer support tube 1614 to connect in the circumferential direction and is connected to the strut passage 1670 formed inside the third strut 1623 to receive fuel from the third strut 1623. A plurality of outer injection holes 1632 for injecting fuel are formed on the inner surface of the outer support tube 1614 and are connected to the outer transfer passage 1654.

Because the outer support tube 1614 forms a part of the nozzle shroud 1420, the outer transfer passage 1654 and the outer injection hole 1632 are formed in the nozzle shroud 1420 to inject fuel into the first premix passage 1451.

The first strut 1621 protrudes from the main cylinder 1410 and has a strut injection hole 1640 for injecting fuel. In detail, the first strut 1621 protrudes from the inner support tube 1611 constituting the main cylinder 1410. A strut passage 1670 is formed inside the first strut 1621 and is connected to the outer support tube 1614 and the first support tube 1612, and the strut injection hole 1640. The first strut 1621 is positioned between the inner support tube 1611 and the first support tube 1612.

The second strut 1622 protrudes from the first support tube 1612 and has a strut injection hole 1640 for injecting fuel. A strut passage 1670 is formed inside the second strut 1622 and is connected to the first support tube 1612 and the second support tube 1613, and the strut injection hole 1640. The second strut 1622 is positioned between the first support tube 1612 and the second support tube 1613.

The third strut 1623 protrudes from the second support tube 1613 and has a strut injection hole 1640 for injecting fuel. A strut passage 1670 is formed inside the third strut 1623 and is connected to the second support tube 1613 and the outer support tube 1614, and the strut injection hole 1640.

The third strut 1623 is positioned between the second support tube 1613 and the outer support tube 1614. The second strut 1622 is positioned outside the first strut 1621, and the third strut 1623 is positioned outside the second strut 1622.

The first strut 1621, the second strut 1622, and the third strut 1623 may include a portion extending in the longitudinal direction of the main cylinder 1410 and a portion curved with respect to the longitudinal direction of the main cylinder 1410. In order to improve mixing efficiency, swirl angles of the curved portions of the first strut 1621, the second strut 1622, and the third strut 1623 may be formed differently.

If the mixing bar 1521 is installed in front of the peg 1530 as in the first exemplary embodiment, fuel and air injected from the peg 1530 can be efficiently mixed by the mixing bar 1521. In addition, because the twist guides 1522 are installed between the mixing bars 1521, fuel and air can be more evenly mixed by the mixing bars 1521 and the twist guides 1522.

Further, because the fuel injection module 1600 includes a plurality of struts 1621, 1622, and 1623 and support tubes 1611, 1612, 1613, and 1614, and fuel is injected through the plurality of struts 1621, 1622, and 1623 and support tubes 1611, 1612, 1613, and 1614, the fuel can be uniformly injected into the first premix passage 1451.

Figure 10:
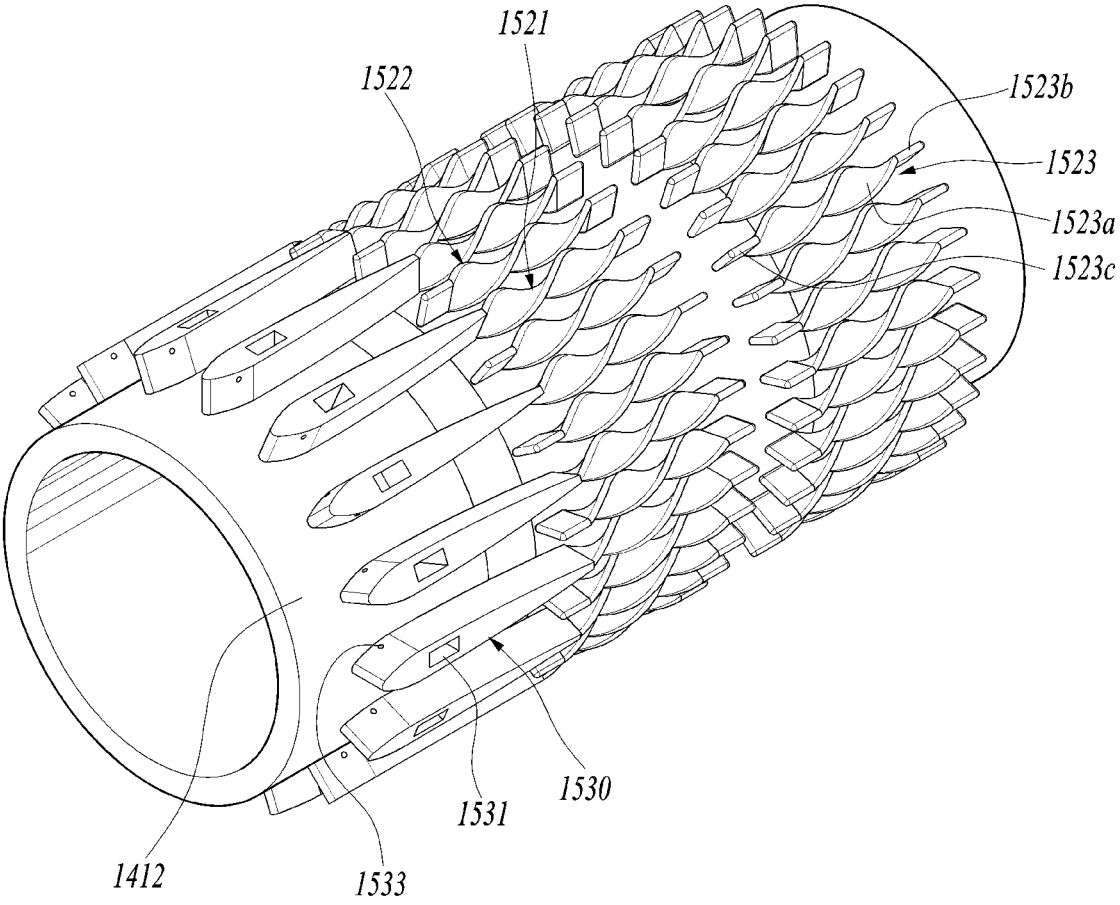
FIG. 10 is a perspective view illustrating a part of a nozzle according to a second exemplary embodiment.

Hereinafter, a gas turbine according to a second exemplary embodiment will be described. FIG. 10 is a perspective view illustrating a part of a nozzle according to a second exemplary embodiment.

Referring to FIG. 10, because the gas turbine according to the second exemplary embodiment has the same structure as the gas turbine according to the first exemplary embodiment, except for auxiliary guides 1523, a redundant description of the same configuration will be omitted.

Auxiliary guides 1523 are installed in front of the mixing bars 1521 and the twist guides 1522 to once again mix the fuel premixed by the mixing bars 1521 and the twist guides 1522. The auxiliary guides 1523 are spaced apart from each other in the circumferential direction of the inner tube 1411.

The auxiliary guides 1523 may be disposed behind a space between the mixing bars 1521 and the twist guides 1522 such that the auxiliary guides 1523 may be alternately disposed with the mixing bars 1521 and the twist guides 1522. Accordingly, a portion of air that has passed through the mixing bar 1521 and a portion of air that has passed through the twist guide 1522 may be introduced into one auxiliary guide 1523 and mixed by the auxiliary guide 1523.

The auxiliary guide 1523 includes a twist part 1523*a*, a first plate part 1523*b* fixed to a front side of the twist part 1523*a*, and a second plate part 1523*c* fixed to a rear side of the twist part 1523*a*. The first plate part 1523*b* and the second plate part 1523*c* have a planar shape and are spaced apart from each other with the twist part 1523*a* interposed therebetween. The twist part 1523*a* is formed of a flat rod twisted with respect to a central axis of the auxiliary guide 1523.

As described above, according to the second exemplary embodiment, the auxiliary guide 1523 is installed so that the fuel and air discharged from the mixing bars 1521 and the twist guides 1522 can be mixed more evenly.

Figure 11:
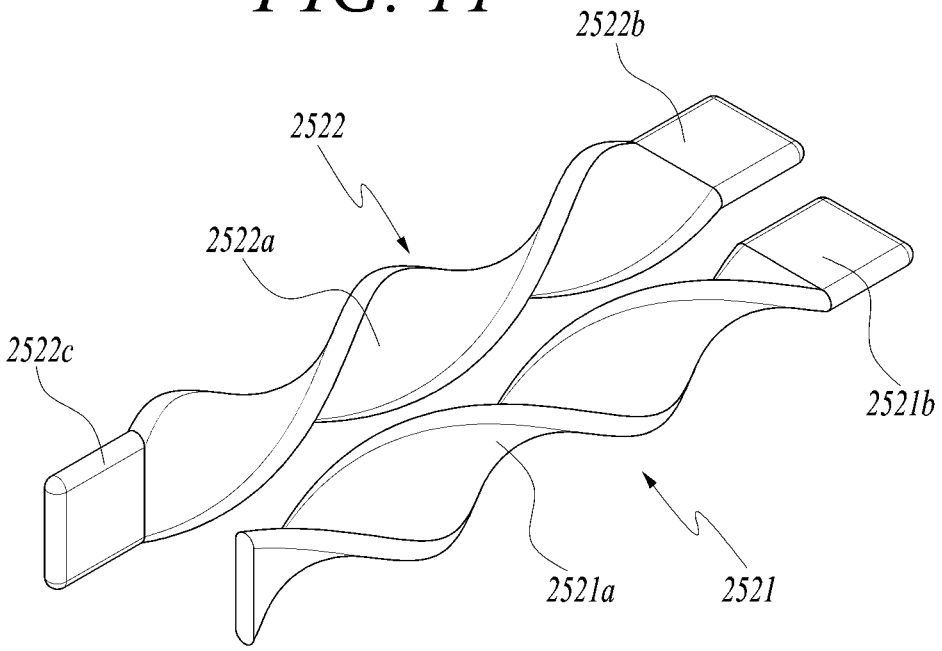
FIG. 11 is a perspective view illustrating a mixing bar and a twist guide according to a third exemplary embodiment.

Hereinafter, a gas turbine according to a third exemplary embodiment will be described. FIG. 11 is a perspective view illustrating a mixing bar and a twist guide according to a third exemplary embodiment.

Referring to FIG. 11, because the gas turbine according to the third exemplary embodiment has the same structure as the gas turbine according to the first exemplary embodiment except for the mixing bars 2521 and the twist guides 2522, a redundant description of the same configuration will be omitted.

The mixing bar 2521 includes a twist part 2521*a* twisted about a central axis and a first plate part 2521*b* fixed to a front side of the twist part 2521*a*. The rear side of the twist part 2521*a* is fixed to the front side of the peg 2530 so that the mixing bar 2521 mixes the fuel and air injected from the peg 2530. The first plate part 2521*b* is disposed perpendicular to the radial direction of the main cylinder 2410 and parallel to the longitudinal direction of the main cylinder 2410. To this end, the twist part 2521*a* may be rotated by 270 degrees or 450 degrees.

The twist guide 2522 includes a twist part 2522*a*, a first plate portion 2522*b* fixed to a front of the twist portion 2522*a*, and a second plate part 2522*c* fixed to a rear side of the twist part 2522*a*. The first plate part 2522*b* and the second plate part 2522*c* have a planar shape and are spaced apart from each other with the twist part 2522*a* interposed therebetween. The twist part 2522*a* has a structure in which a flat rod is twisted.

The first plate part 2522*b* is disposed perpendicular to the radial direction of the main cylinder 2410 and parallel to the longitudinal direction of the main cylinder 2410. The second plate part 2522*c* may be disposed parallel to the radial direction of the main cylinder 2410. To this end, the twist part 2522*a* may be twisted 270 degrees or 450 degrees.

The mixing bars 2521 and the twist guides 2522 are alternately arranged around the circumference of the main cylinder 2410 such that lateral sides of the mixing bars 2521 and the twist guides 2522 are overlapped for efficient mixing of fuel. The mixing bar 2521 and the twist guide 2522 may be twisted in different directions, that is, in opposite directions. For example, if the mixing bar 2521 is twisted clockwise, the twist guide 2522 may be twisted counterclockwise. Accordingly, swirls rotating in different directions are formed so that the mixing efficiency of fuel and air can be further improved.

Figure 12:
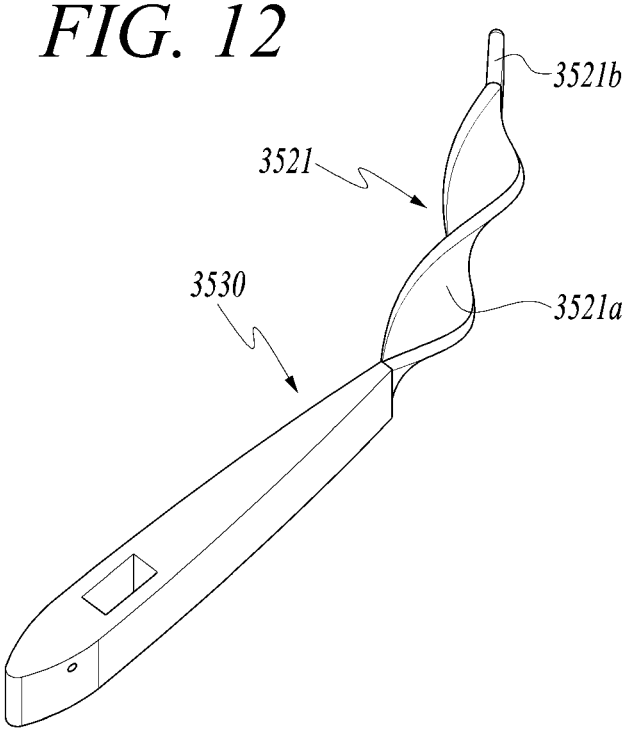
FIG. 12 is a perspective view illustrating a peg and a mixing bar according to a fourth exemplary embodiment.

Hereinafter, a gas turbine according to a fourth exemplary embodiment will be described. FIG. 12 is a perspective view illustrating a peg and a mixing bar according to a fourth exemplary embodiment.

Referring to FIG. 12, because the gas turbine according to the fourth exemplary embodiment has the same structure as the gas turbine according to the first exemplary embodiment, except for pegs and mixing bars, a redundant description of the same configuration will be omitted.

The peg 3530 injects fuel into a space between the inner tube and the outer tube, and guides an air flow. The mixing bar 3521 is provided on the front side of the peg 3530 to mix fuel and air.

The mixing bar 3521 is formed of an elongated plate shape and has a structure twisted with respect to a central axis of the mixing bar 3521. Accordingly, lateral sides of the mixing bar 3521 extend in a spiral pattern. The mixing bar 3521 includes a twist part 3521*a* and a first plate part 3521*b* fixed to a front side of the twist part 3521*a*. In addition, the mixing bar 3521 may be formed to extend in a direction inclined to the longitudinal direction of the main cylinder. The central axis of the mixing bar 3521 has a structure curved in an arc shape with respect to the longitudinal direction of the main cylinder.

Accordingly, the mixing bar 3521 may induce swirls that rotate with respect to the central axis of the mixing bar 3521 as well as induce swirls that rotate with respect to the central axis of the main cylinder. Accordingly, the mixing efficiency of fuel and air can be further increased.

While one or more exemplary embodiments have been described with reference to the accompanying drawings, it will be apparent to those skilled in the art that various modifications and variations can be made through addition, change, omission, or substitution of components without departing from the spirit and scope of the disclosure as set forth in the appended claims, and these modifications and changes fall within the spirit and scope of the disclosure as defined in the appended claims.

What is claimed is:

1. A combustor nozzle comprising:

a main cylinder having a fuel passage through which fuel flows and including an inner tube and an outer tube surrounding the inner tube, a nozzle shroud surrounding the main cylinder, a premix passage in which air and fuel are mixed, wherein the premix passage includes:

a plurality of pegs configured to inject fuel and guide an air flow;

a plurality of mixing bars configured to mix air and fuel injected from the plurality of pegs; and a plurality of twist guides configured to additionally mix air and fuel injected from the plurality of pegs, wherein a portion of the mixing bar is twisted between 90 to 720 degrees with respect to a central axis thereof; a portion of the twist guide is twisted between 90 to 720 degrees with respect to a central axis thereof; a rear side of the mixing bar is fixed to a front side of the peg; a rear side of the twist guide is not fixed to the peg; the plurality of the twist guide is disposed between the plurality of mixing bars; and the plurality of pegs, the plurality of mixing bars, and the plurality of twist guides are disposed between an outer circumferential surface of the inner tube and an inner circumferential surface of the outer tube.

2. The combustor nozzle according to claim 1, wherein each of the plurality of mixing bars comprises a twist part and a first plate part fixed to a front side of the twist part, wherein a rear side of the twist part is fixed to the front side of the peg.

3. The combustor nozzle according to claim 2, wherein the twist part of each of the plurality of mixing bars has a first section rotated 180 degrees and a second section positioned in front of the first section and rotated 180 degrees, wherein the second section is formed to be longer than the first section.

4. The combustor nozzle according to claim 1, wherein the twist guide comprises a twist part, a first plate part fixed to a front side of the twist part, and a second plate part fixed to a rear side of the twist part.

5. The combustor nozzle according to claim 4, wherein the first plate part and the second plate part are disposed parallel to a radial direction of the main cylinder.

6. The combustor nozzle according to claim 4, wherein the first plate part is disposed parallel to a radial direction of the main cylinder, and the second plate part is disposed perpendicular to the radial direction of the main cylinder.

7. The combustor nozzle according to claim 1, wherein the twist guide and the mixing bar are twisted in different directions.

8. The combustor nozzle according to claim 1, wherein a plurality of auxiliary guides are disposed in front of the plurality of mixing bars and the twist guide such that the auxiliary guide is alternately disposed with the mixing bar and the twist guide, the auxiliary guide having a twist part twisted about a central axis thereof.

9. The combustor nozzle according to claim 1, wherein each of the mixing bars is curved with respect to a longitudinal direction of the main cylinder.

10. The combustor nozzle according to claim 1, further comprising:

a fuel injection module disposed between the main cylinder and the nozzle shroud to inject fuel, wherein the fuel injection module comprises a plurality of first struts each protruding from the main cylinder and having an injection hole for injecting fuel, and a first support tube coupled to outer sides of the first struts and having a plurality of intermediate injection holes for injecting fuel.

11. The combustor nozzle according to claim 10, wherein an intermediate transfer passage is disposed inside the first support tube to extend in a circumferential direction, wherein the intermediate transfer passage is connected to a strut passage formed inside the first strut.

12. The combustor nozzle according to claim 10, wherein the fuel injection module further comprises a plurality of second struts each protruding from the first support tube and having a strut injection hole for injecting fuel, wherein the second strut has a strut passage connected to the strut injection hole, the strut passage being connected to the intermediate transfer passage.

13. The combustor nozzle according to claim 12, wherein the fuel injection module further comprises a second support tube connecting outer sides of the second struts and a plurality of third struts protruding from the second support tube, wherein the nozzle shroud includes an outer transfer passage connected to the third struts to extend in the circumferential direction of the nozzle shroud.

14. A combustor comprising:

a burner having a plurality of nozzles configured to inject fuel and air; and a duct assembly coupled to one side of the burner to burn a mixture of the fuel and air and transmit combustion gas to a turbine, wherein each of the plurality of nozzles comprises:

a main cylinder having a fuel passage through which fuel flows and including an inner tube and an outer tube surrounding the inner tube;

a nozzle shroud surrounding the main cylinder; and a premix passage in which air and fuel are mixed, wherein the premix passage includes:

a plurality of pegs configured to inject fuel and guide an air inflow in the premix passage;

a plurality of mixing bars configured to mix air and fuel injected from the plurality of pegs; and a plurality of twist guides configured to additionally mix air and fuel injected from the plurality of pegs, wherein a portion of the mixing bar is twisted between 90 to 720 degrees with respect to a central axis thereof; a portion of the twist guide is twisted between 90 to 720 degrees with respect to a central axis thereof; a rear side of the mixing bar is fixed to a front side of the peg; a rear side of the twist guide is not fixed to the peg; the plurality of the twist guide is disposed between the plurality of mixing bars; and the plurality of pegs, the plurality of mixing bars, and the plurality of twist guides are disposed between an outer circumferential surface of the inner tube and an inner circumferential surface of the outer tube.

15. A gas turbine comprising:

a compressor configured to compress air introduced from an outside;

a combustor configured to mix the air compressed by the compressor with fuel and combust an air-fuel mixture to produce high-temperature and high-pressure combustion gas; and a turbine having a plurality of turbine blades rotating by the combustion gas produced by the combustor, wherein the combustor comprises a burner having a plurality of nozzles configured to inject fuel and air, and a duct assembly coupled to one side of the burner to burn a mixture of the fuel and air and transmit combustion gas to the turbine, wherein each of the plurality of nozzles comprises a main cylinder having a fuel passage through which fuel flows and including an inner tube and an outer tube surrounding the inner tube, a nozzle shroud surrounding the main cylinder, and a premix passage in which air and fuel are mixed, a plurality of pegs configured to inject fuel and guide an air inflow in the premix passage, and a plurality of mixing bars configured to mix air and fuel injected from the plurality of pegs, and a plurality of twist guides configured to additionally mix air and fuel injected from the plurality of pegs, wherein a portion of the mixing bar is twisted between 90 to 720 degrees with respect to a central axis thereof; a portion of the twist guide is twisted between 90 to 720 degrees with respect to a central axis thereof; a rear side of the mixing bar is fixed to a front side of the peg; a rear side of the twist guide is not fixed to the peg; the plurality of the twist guide is disposed between the plurality of mixing bars; and the plurality of pegs, the plurality of mixing bars, and the plurality of twist guides are disposed between an outer circumferential surface of the inner tube and an inner circumferential surface of the outer tube.

* * * * *